US005338509A

United States Patent [19]

Coupland et al.

[11] Patent Number: 5,338,509

[45] Date of Patent: Aug. 16, 1994

[54] METHOD OF USING PD-ALLOY PINNING WIRES IN TURBINE BLADE CASTING

[75] Inventors: Duncan R. Coupland, High Wycombe; Mark L Doyle, Alperton, both of England

[73] Assignee: Johnson Matthey Public Limited Company, London, England

[21] Appl. No.: 118,354

[22] Filed: Sep. 9, 1993

Related U.S. Application Data

[62] Division of Ser. No. 946,639, Sep. 18, 1992, abandoned.

[30] Foreign Application Priority Data

Sep. 20, 1991 [GB] United Kingdom ..... 9120161.6

[51] Int. Cl.[5] ..... C22C 5/00

[52] U.S. Cl. ..... 420/463; 148/430; 428/670

[58] Field of Search ..... 420/463; 148/430; 428/670

[56] References Cited

U.S. PATENT DOCUMENTS

| | | | |
|---|---|---|---|
| 2,636,819 | 4/1955 | Streicher | 420/463 |
| 2,890,114 | 6/1959 | Ruthardt et al. | 420/463 |
| 3,305,817 | 2/1967 | Doi | 420/463 |
| 4,123,595 | 10/1978 | Chang | 428/670 |
| 4,719,081 | 1/1988 | Mizuhara | 420/463 |
| 4,806,306 | 2/1989 | Groll et al. | 420/467 |
| 4,917,968 | 4/1990 | Tuffias et al. | 428/670 |
| 5,075,076 | 12/1991 | Guerlet et al. | 420/463 |
| 5,139,891 | 8/1992 | Cowie et al. | 428/670 |

FOREIGN PATENT DOCUMENTS

| | | |
|---|---|---|
| 0084234 | 7/1983 | European Pat. Off. . |
| 0324229 | 7/1989 | European Pat. Off. . |
| 8335859 | 5/1986 | Fed. Rep. of Germany . |
| 539644 | 9/1941 | United Kingdom . |
| 801034 | 9/1958 | United Kingdom . |
| 1025654 | 4/1966 | United Kingdom . |
| 1027636 | 4/1966 | United Kingdom . |
| 1171674 | 11/1969 | United Kingdom . |
| 1498560 | 1/1978 | United Kingdom . |
| 2111528 | 7/1983 | United Kingdom . |
| 2118078 | 10/1983 | United Kingdom . |

*Primary Examiner*—Upendra Roy
*Attorney, Agent, or Firm*—Cushman, Darby & Cushman

[57] ABSTRACT

Pinning wires suitable for use in turbine blade manufacture comprise palladium alloyed with one or more noble and/or refractory metals, and are substantially more cost effective than conventional pinning wires.

9 Claims, No Drawings

METHOD OF USING PD-ALLOY PINNING WIRES IN TURBINE BLADE CASTING

This is a division of application Ser. No. 07/946,639, filed on Sep. 18, 1992, which was abandoned upon the filing hereof on Nov. 9, 1993.

This invention relates to pinning wire products and in particular to pinning wires for use in turbine blade manufacture.

Advanced gas turbines are required to operate at as high a temperature as possible to maximise fuel efficiency. The turbine blades in these engines must be air cooled to maintain adequate strength. This is achieved by casting blades into patterns which are ceramic moulds containing special ceramic cores which are removed prior to service. Unfortunately, due to the complex nature of these poorly supported patterns, drift or movement can occur during production which causes high scrap rates.

Core pinning technology using fine platinum wires has been developed to overcome these problems. In a typical case seven to ten pins, each of 5 to 10 mm in length are required for a 2 inch blade. The pins are inserted into a wax preform and butt against the ceramic core. The wax is coated with a zirconium silicate/alumina shell mould and fired at 850° C. to 1130° C. in air, for between 1 and 50 hours. After firing and burning out of the wax the mould assemblies are heated to approximately 1475° C. in a vacuum for 20 minutes, prior to pouring of the molten superalloy at a temperature of approximately 1550° C., into the mould. The pinning wires dissolve in the molten superalloy. Finally the mould is withdrawn out of the bottom of the furnace, at a controlled rate which aids optimum grain structure in the turbine blade.

In use, therefore, the pinning wire must be capable of surviving and maintaining adequate strength at temperatures of the order of 850° C. to 1130° C. in air with minimal oxidation and approximately 1475° C. in vacuum with minimal metal loss. In addition, it must dissolve evenly in the molten casting alloy without producing any detrimental effects on the physical or mechanical characteristics of the finished turbine blade, such as spurious grain nucleation. Presently, pure platinum wire or grain stabilised platinum wire is employed. The high cost of platinum makes the pinning wires very expensive.

An object of the present invention is to provide alternative pinning wire products which perform at least as well as those currently employed in industry, but which are substantially more cost effective.

Accordingly, the present invention provides pinning wires comprising alloys of palladium with one or more noble and/or refractory metals.

Said alloys preferably have melting points equal to, or higher than the melting point of Pd.

Preferably the alloys have melting points higher than the melting point of Pd.

Suitable noble and refractory metals for alloying with Pd include Ta, Mo, W, Nb, Hf, Cr, Re, Pt, Ru, Ir, Os and Rh. Normally such metals should be present in amounts of 0–30% by weight based on the total weight of alloy; however, the complete mutual solid solubility properties of Pt in Pd allows it to be present in any amount.

In addition, it may be beneficial to add small amounts of one or more other metals, such as Cu, Cr, Al, Ta or Pt, to increase the alloy's resistance to oxidation. Preferably these metals are present in the alloy in amounts of 0–10% and especially 0–5% by weight based on the total weight of alloy.

Some alloys may also benefit from a thin protective coating of one or more of Pt, Pd, Ir, Rh and Au.

Oxide dispersion strengthening and/or grain stabilising may be promoted in some Pd-rich alloys through minor additions (up to 1% of total weight of alloy) of metals such as Zr, Ni, Co, Mn, V, Cr, and Ti.

The pinning wires according to the invention are normally of 0.5–0.6mm in diameter, although for certain applications diameters may range from 0.3–1.5 mm. They may be prepared by conventional wire drawing, and may be supplied as reels of wire or pre-cut into pins which are usually 6–8 mm in length, although for large blades the pins may be up to 2 cm in length.

The invention will now be described by example only.

EXAMPLE

The samples produced were:

| | |
|---|---|
| Group I | (0.6 mm diameter wires) |
| (i) | Pd—20% W |
| (ii) | Pd—15% Mo |
| (iii) | $Pd_{47.5}Pt_{47.5}W_5$ |
| (iv) | $Pd_{47.5}Pt_{47.5}Ta_5$ |
| (v) | $Pd_{40}Pd_{60}Zr_{0.1}$ |
| (vi) | Pd—20% W (Pt-coated to 5 μm) |
| (vii) | Pd—15% Mo (Pt-coated to 5 μm) |
| Group II | (sheets) |
| (i) | Pd—20% W |
| (ii) | Pd—15% Mo |
| (iii) | Pd—16% W—4 Ir |
| (iv) | Pd—11% Mo—4 Ir |
| (v) | Pd—15% W—5 Pt |
| (vi) | Pd—10% Mo—5 Pt |
| (vii) | Pd—10% Mo—5 Ta |
| (viii) | Pd—15% W—10 Au |
| (ix) | Pd—20% W—10 Au |

All the above samples have a melting point higher than that of Pd.

Two tests were performed on the manufactured wire/sheet:

Group I (wires)

1. Oxidation Test—eighteen hours in air at 850° C.
2. High temperature vacuum test—one hour at 1450° C. in vacuum.

Group II (sheets)

1. Oxidation test—8 hours in air at 1075° C.
2. High temperature vacuum test—30 minutes at 1475° C. in vacuum.

RESULTS

Oxidation Test-Group I

After 18 hours in air at 850° C. the PtPdZr sample showed no trace of oxide formation. The Pd-Mo, PdPtTa, PdPtW and Pd-W samples all showed signs of a thin blue/pink surface oxide. There was no thick oxide or spalling on any of the samples.

The diameter of each of the wires was unchanged by the oxidation treatment.

The Pt-coated Pd-W wire behaved in a very similar manner to the uncoated specimen recording a very small weight gain and diameter increase. However, the Pt-coated Pd-Mo wire behaved very differently compared to its uncoated counterpart. The coated wire 'swelled' so that its diameter was increased by 17.5% while the wire suffered a 14% mass reduction.

Metallography of the samples was carried out to assess any internal damage to the wires;

TABLE 1

| Group I | |
|---|---|
| Sample | Oxidation Damage |
| Pt | no damage |
| PtPdZr | no damage |
| PdPtW | surface rough but no oxide penetration |
| PdPtTa | surface rough but no oxide penetration |
| Pd—Mo | voids in sub-surface layer (to around 1/50th of wire diameter) |
| Pd—W | voids near surface and porosity to 1/5th of wire diameter |
| Pd—Mo (coated) | suffers 14% weight loss and the wire 'swells' by 17.5% (diameter) |
| Pd—W (coated) | very small weight gain |

High Temperature Vacuum Test-Group I

A visual examination of the samples following a one hour treatment at 1475° C. showed that all the surfaces were a dull grey. Those which previously were coated with a thin oxide had substantially different appearance after the high temperature treatment.

Metallography of the samples was conducted to assess any internal damage.

The samples were also weighed and their dimensions recorded prior to, and following the testing. Table 2 summarises the weight losses. section size changes and metallographic information of the samples. Also included for comparison with Group I results are data for Pd and Pt wires which underwent similar oxidation and high temperature vacuum treatments;

TABLE 2

| Samples | % Diameter reduction | Weight loss % | Observations |
|---|---|---|---|
| Pt | 0 | 0 | no loss of material |
| PtPdZr | 5 | 7 | very few surface voids |
| PdPtW | 5 | 8 | some voids near surface |
| PdPtTa | 0 | 5 | some voids near surface |
| Pd—Mo | 7 | 20 | large surface voids collapsed/ volatilised leaving rough surface |
| Pd—Mo (coated) | 0 | 62 | massive metal loss leading to a 'spongy' final wire with no strength, cracks appeared in the Pt coat |
| Pd—W | 16 | 32 | heavy voiding to 1/5th of wire diameter |
| Pd—W (coated) | 4 | 17 | some cracks appeared in the Pt coat |
| Pd | 75 | 95 | massive metal loss |

Oxidation Test and High Temperature Vacuum Test-Group II

Stage 1. Oxidation test; cool to room temperature.

Stage 2. High temperature vacuum test; cool to room temperature.

Metallography of the samples was conducted to assess any internal damage.

The samples were also weighed and their dimensions recorded prior to, and following the testing. Table 3 summarises the weight losses and metallographic information of the samples.

TABLE 3

| Alloy | % Wt Change After Stage 1 | % Wt Change After Stage 2 | Observations |
|---|---|---|---|
| Pd—20 W | +0.76 | −17.38 | Very minor surface blistering after stage 1. Oxide penetrations to 0.3 mm. No deterioration in surface condition after stage 2 but all oxide vaporised to leave Pd-rich surface. |
| Pd—15 Mo | −11.21 | −28.23 | Internal delamination around edges of sample after stage 1. Oxide penetration to 0.5–0.6 mm. Delamination increased after stage 2. Large voids remaining in previously oxidised area. Substantial if not complete oxide vaporisation after stage 2. |
| Pd—16 W—4 Ir | +0.06 | −9.95 | Surface blistering after stage 1. No further deterioration after stage 2. Oxide penetration to approximately 0.2–0.3 mm after stage 1 but this was substantially vaporised after stage 2. |
| Pd—11 Mo—4 Ir | −1.87 | −10.35 | Discolouration, but otherwise perfect surface after state 1. No deterioration after stage 2. Oxide penetration to 0.2 mm after stage 1. Substantial cleaning out of oxidised material after stage 2. |
| Pd—15 W—5 Pt | +0.67 | −7.46 | Obvious surface blistering after stage 1 with oxide penetration to 0.2–0.4 mm. Blistering disappeared after stage 2 and sub-surface oxidation intermittently penetrated to 0.1–0.3 mm. |

TABLE 3-continued

| Alloy | % Wt Change After Stage 1 | % Wt Change After Stage 2 | Observations |
|---|---|---|---|
| Pd—10 Mo—5 Pt | 0.00 | −2.88 | Surface condition perfect after both stages. Oxide penetrations up to 0.13 mm substantially stable after stage 2. |
| Pd—10 Mo—5 Ta | −2.15 | −4.00 | Surface condition perfect after both stages. Oxide penetration to 0.3 mm substantially stable after stage 2. Tantalum obviously forming stable oxide. |
| Pd—15 W—10 Au | +1.13 | −5.08 | Very good surface condtion after stage 1. No deterioration after stage 2. Oxide penetration to 0.25 mm. Substantial loss of oxide from near surface regions after stage 2. |
| Pd—20 W—10 Au | +1.24 | −11.3 | Severe surface oxidation evident after stage 1. Blistering disappeared after stage 2. Oxide penetration to 0.34 mm, present intermittently after stage 2. |

The Tables show variation in properties as the amount of Pt is reduced. However, it is clear that all the Pd alloy based wires performed to a level where any of them are potential new pinning wire materials.

The suitability of the Pd alloy based wires as pinning wires is particularly surprising when compared with the inadequate performance of pure Pd.

The substitution of 15% Mo and 20% W into Pd has a remarkable effect on the metal loss by volatilisation at 1475° C. in a vacuum. In addition these wires suffered far less grain growth at high temperatures than did the Pt, Pd and Pd-Pt-refractory metal samples. The oxidation problems anticipated with these materials appear manageable. Neither wire suffered catastrophic oxidation which is surprising since neither the Mo or W form 'protective' oxides. Particularly interesting was the behaviour of the Pd-Mo wire. After oxidation at 850° C., voids formed under the oxidised surface. Subsequently during the high temperature vacuum treatment the surface appeared to be lost possibly due to the volatile nature of the oxide layer, leaving a rough but clean pin. In this case, coating of the wire resulted in a greatly increased mass loss. However, coating may be beneficial in other cases—the effect of coating the Pd-W sample appears to have been beneficial halving the weight loss and reducing the diameter reduction to a quarter of the value recorded for the uncoated wire.

The PdPtTa wire suffered minimal mass loss and no reduction in wire diameter. The resistance to high temperature metal loss was similar to that of pure Pt. The PdPtW wire behaves similarly.

It is obviously important that any potential pinning wire material does not have deleterious effects on the host alloy. In the first instance it is important that the pinning wire elements are dispersed uniformly. Casting trials have been performed to produce aerofoil shapes. Analysis of these for the elements in the pinning wires was performed and the results are contained in Table 4 below.

TABLE 4

Analysis of Investment Cast Aerofoil Shapes

| Pinning Wire Alloy | Nominal Concentration in Aerofoil Pt % | Nominal Concentration in Aerofoil Pd % | Analysis Site | Analysed Concentration in Aerofoil Pt(%) ± 0.05 | Analysed Concentration in Aerofoil Pd(%) ± 0.05 |
|---|---|---|---|---|---|
| Pd—15% Mo | — | 0.21 | Root | — | 0.12 |
| | — | 0.21 | Blade | — | 0.15 |
| | — | 0.21 | Tip | — | 0.15 |
| Pd—20% W (Pt Coated) | 0.01 | 0.19 | Root | — | 0.1 |
| | 0.01 | 0.19 | Blade | 0.1 | 0.14 |
| | 0.01 | 0.19 | Tip | 0.02 | 0.11 |
| $Pt_{47.5}Pd_{47.5}Ta_{0.5}$ | 0.12 | 0.12 | Root | 0.14 | 0.16 |
| | 0.12 | 0.12 | Blade | 0.27 | 0.01 |
| | 0.12 | 0.12 | Tip | 0.05 | 0.05 |
| | 0.25 | — | Root | 0.36 | — |
| | 0.25 | — | Blade | 0.1 | — |
| | 0.25 | — | Tip | 0.27 | — |

These results indicate that palladium disperses through the nickel based casting alloys at least as well as platinum. This is beneficial since concentration of one element may lead to localised variation in blade properties, which must be avoided.

There is considerable difficulty in obtaining satisfactory results of this type but the indications are that palladium and non-platinum bearing palladium alloys dispose through the host nickel alloys more easily than platinum or the palladium alloys bearing platinum.

Two nickel superalloy compositions (A and B) containing the individual dissolved pinning wire alloys were tested for stress rupture. Three pinning wires according to the invention were selected (wire X is Pd20W coated with Pt; Y is Pd15Mo; Z is 47.5Pd47.5Pt5Ta). Special blocks were directionally solidified and samples machined from them. The test conditions and results are presented in Table 5.

The results demonstrated that the use of these alloys is not deleterious to longitudinal stress rupture properties in the alloys tested when compared to the current standard material, platinum. Indeed, marginal benefits may be achievable.

TABLE 5

| Nickel Alloy | Pinning Addition | Wire % | Longitudinal Temperature °C. | Applied Stress MPa | Sample Size | Average Life in Hours |
|---|---|---|---|---|---|---|
| A | — | — | 1040 | 145 | 3 | 52 |
| A | X Y | 0.25 | 1040 | 145 | 4 | 48 |
| A | Z | 0.25 | 1040 | 145 | 5 | 48 |
| A | | 0.25 | 1040 | 145 | 5 | 48 |
| A | — | — | 850 | 500 | 3 | 79 |
| A | X Y | 0.25 | 850 | 500 | 5 | 69 |
| A | Z | 0.25 | 850 | 500 | 5 | 75 |
| A | | 0.25 | 850 | 500 | 5 | 72 |
| B | Pt | 0.25 | 1040 | 145 | 3 | 56 |
| B | X Y | 0.13 | 1040 | 145 | 3 | 60 |
| B | | 0.15 | 1040 | 145 | 3 | 62 |
| B | Pt | 0.25 | 850 | 500 | 3 | 84 |
| B | X | 0.13 | 850 | 500 | 3 | 87 |
| B | Y | 0.15 | 850 | 500 | 3 | 92 |

We claim:

1. In the production of turbine blades by casting using pinning wire to support a mould, the improvement comprising using as the pinning wire a palladium alloy wire comprising an alloy of palladium and at least one member of the group consisting of noble and refractory metals.

2. A method as claimed in claim 1, wherein said alloy has a melting point equal to or higher than the melting point of Pd.

3. A method as claimed in claim 1, wherein said noble and/or refractory metal is selected from the group Ta, Mo, W, Nb, Hf, Cr, Re, Pt, Ru, Ir, Os and Rh.

4. A method as claimed in claim 1, wherein said alloy contains 0–10% of one or more of Cu, Cr, Al, Ta and Pt.

5. A method as claimed in claim 1, wherein said alloy is coated with Pt, Pd, Ir or Rh.

6. A method as claimed in claim 1, wherein said alloy contains up to 1% of one or more of Zr, Ni, Co, Mn, V, Cr and Ti.

7. A method as claimed in claim 2, wherein said alloy has a melting pint higher than the melting point of Pd.

8. A method as claimed in claim 3, wherein said noble and/or refractory metal is selected from the group Ta, Mo, W and Pt.

9. A method as claimed in claim 3, wherein each of said noble and/or refractory metals is present in the alloy in an amount of up to 30% by weight of the total weight of the alloy.

* * * * *